US008678020B2

(12) United States Patent
Renaud-Goud et al.

(10) Patent No.: US 8,678,020 B2
(45) Date of Patent: Mar. 25, 2014

(54) GRIP FOR A SPORTS POLE

(75) Inventors: Gilles Renaud-Goud, Gruffy (FR); Stéphane Latruffe, La Balme de Sillingy (FR)

(73) Assignee: Salomon S.A.S., Metz-Tessy (FR)

( * ) Notice: Subject to any disclaimer, the term of this patent is extended or adjusted under 35 U.S.C. 154(b) by 354 days.

(21) Appl. No.: 12/894,522

(22) Filed: Sep. 30, 2010

(65) Prior Publication Data

US 2011/0079256 A1 Apr. 7, 2011

(30) Foreign Application Priority Data

Oct. 1, 2009 (FR) ..... 09 04691

(51) Int. Cl.
*A45B 9/02* (2006.01)
*A63C 11/22* (2006.01)

(52) U.S. Cl.
USPC ..... 135/65; 135/72; 280/821; 16/421

(58) Field of Classification Search
USPC ..... 135/65, 72, 76; 16/421, 431, 436; 280/819–823; 473/300–301, 551–552
See application file for complete search history.

(56) References Cited

U.S. PATENT DOCUMENTS

| | | | | |
|---|---|---|---|---|
| 1,694,992 | A * | 12/1928 | Stoeffler | 473/206 |
| 2,946,600 | A | 7/1960 | Cubberley | |
| 3,436,090 | A | 4/1969 | Lange et al. | |
| 3,817,521 | A | 6/1974 | Wright | |
| 4,750,760 | A | 6/1988 | Gurley | |
| 4,775,168 | A | 10/1988 | Dalebout | |
| 4,790,562 | A | 12/1988 | Skard | |
| 5,092,629 | A | 3/1992 | Bagneres et al. | |
| D325,238 | S * | 4/1992 | Pokkinen et al. | D21/775 |
| 5,123,674 | A | 6/1992 | Bagneres et al. | |
| 5,248,163 | A | 9/1993 | Dondero | |
| 5,287,870 | A | 2/1994 | Rhodes | |
| 5,316,340 | A | 5/1994 | Malsev | |
| 5,887,282 | A | 3/1999 | Lenhart | |
| 5,931,749 | A * | 8/1999 | Hagey | 473/551 |
| 5,988,681 | A | 11/1999 | Vesalainen et al. | |
| 6,017,283 | A * | 1/2000 | Hagey | 473/551 |
| 6,139,060 | A | 10/2000 | Lenhart | |
| 6,264,242 | B1 | 7/2001 | Lenhart | |
| 6,305,051 | B1 * | 10/2001 | Cho | 16/430 |
| 6,325,418 | B1 | 12/2001 | Lenhart | |
| 6,386,588 | B1 | 5/2002 | Young et al. | |
| 6,390,109 | B1 * | 5/2002 | Manninen | 135/77 |
| 6,637,773 | B1 * | 10/2003 | Trinen et al. | 280/821 |
| 6,916,260 | B1 * | 7/2005 | Poteet | 473/551 |
| 6,988,745 | B2 * | 1/2006 | Trinen et al. | 280/821 |

(Continued)

FOREIGN PATENT DOCUMENTS

| | | |
|---|---|---|
| EP | 0 370 900 A1 | 5/1990 |
| FR | 2 795 334 A1 | 12/2000 |

(Continued)

*Primary Examiner* — Winnie Yip
(74) *Attorney, Agent, or Firm* — Greenblum & Bernstein, P.L.C.

(57) ABSTRACT

A grip handle adapted to be fixed to the end of a pole for use in an outdoor activity, such as skiing or hiking, including a body and a support member affixed to the body and projecting from a transverse wall of the body, the support member being arranged to support the thumb of a user holding the handle. The support member includes a structure to selectively modify and lock its position with respect to the body.

14 Claims, 5 Drawing Sheets

(56) References Cited

U.S. PATENT DOCUMENTS

| | | | | |
|---|---|---|---|---|
| 7,014,210 | B2 | 3/2006 | Manninen et al. | |
| D527,065 | S | 8/2006 | Schary et al. | |
| 7,322,612 | B2 * | 1/2008 | Trinen et al. | 280/821 |
| 2004/0012189 | A1 | 1/2004 | Trinen et al. | |

FOREIGN PATENT DOCUMENTS

| | | | |
|---|---|---|---|
| FR | 2 871 663 | A1 | 12/2005 |
| WO | WO-98/48979 | A2 | 11/1998 |
| WO | WO-2006/005840 | A1 | 1/2006 |

* cited by examiner

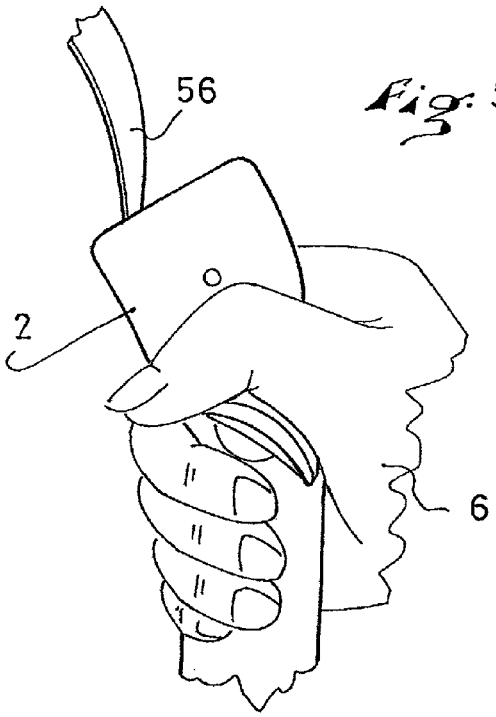
Fig: 5
Fig: 6
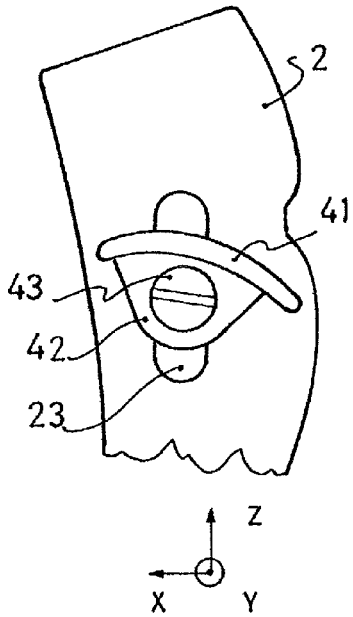
Fig: 7
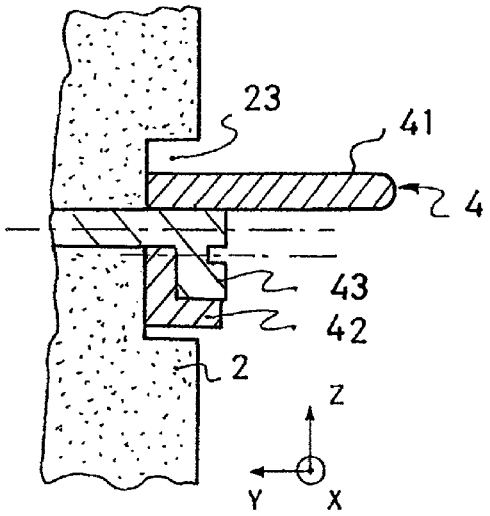

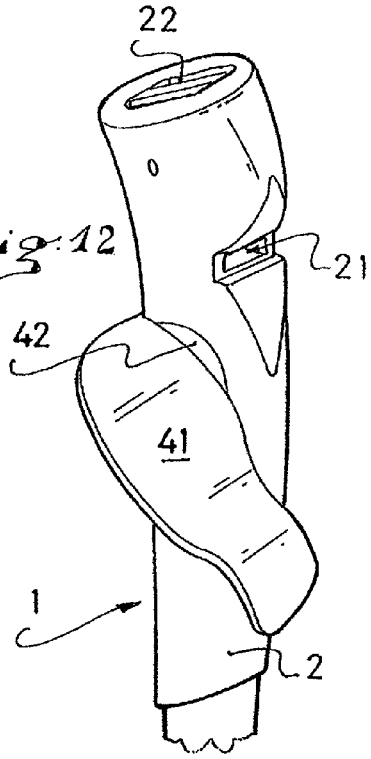
Fig: 12
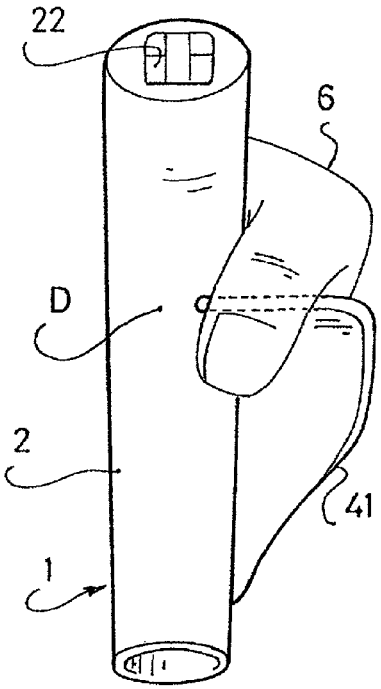
Fig: 13
Fig: 14
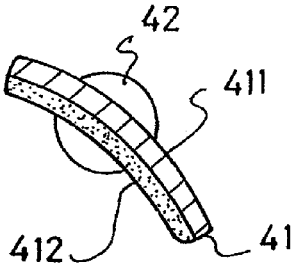

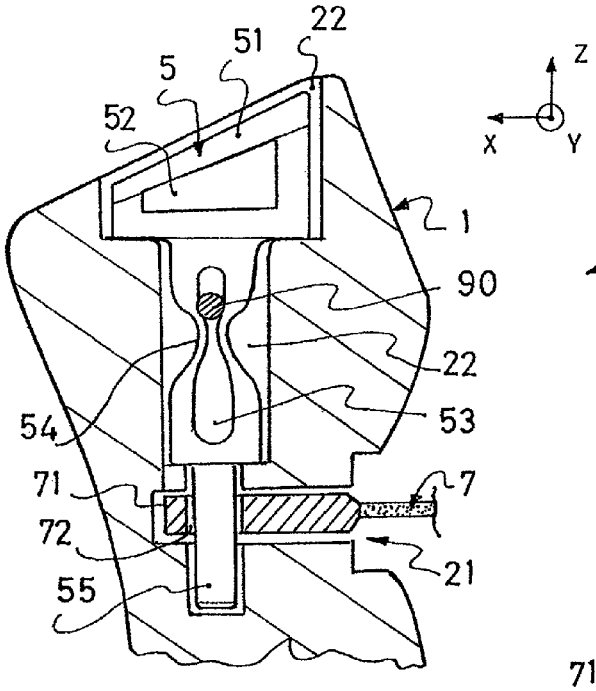
Fig. 15
Fig. 16
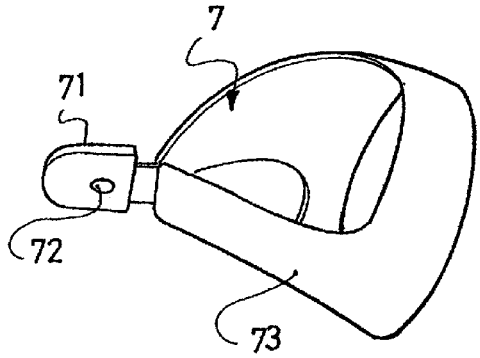
Fig. 17
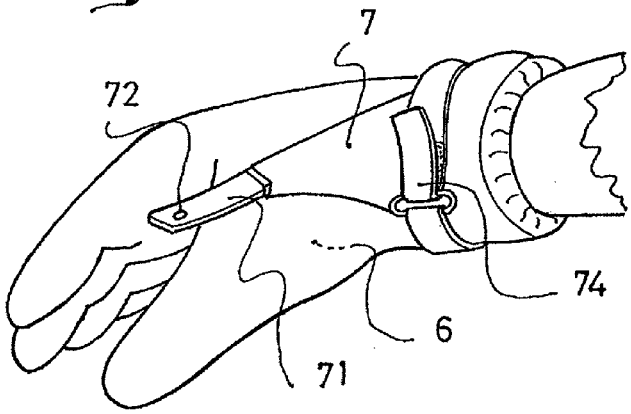

GRIP FOR A SPORTS POLE

CROSS-REFERENCE TO RELATED APPLICATION

This application claims priority under 35 U.S.C. §119 of French Patent Application No 09 04691, filed on Oct. 1, 2009, the disclosure of which is hereby incorporated by reference thereto in its entirety.

BACKGROUND OF THE INVENTION

1. Field of the Invention

The invention relates to sports poles, such as ski poles and walking or hiking poles, and in particular to a grip, or grip handle, attached to the upper portion of such poles.

2. Description of Background and Other Information

On a ski pole or walking or hiking pole, the grip handle is generally provided with a strap forming a closed loop, which is affixed to the handle. This strap, sometimes referred to as the wrist-strap, makes it possible for the user, such as a skier, to pass his or her hand through the loop in order to avoid losing the pole when the handle is released. The wrist-strap also enables a better transmission of the skier's support forces to the pole, which proves particularly advantageous for the stride, such as in cross-country skiing or Nordic hiking, whether in the context of winter sports or summer activities. The wrist-strap also facilitates the transmission of support forces over a longer period of time, even after the user has released the handle.

French Patent document FR 2 795 334 and U.S. Pat. No. 6,637,773 disclose a cross-country ski pole adapted to improve the transmission of a skier's support forces with regard to the pole. The handle is provided with a support point for the thumb in order to optimize the transmission of forces between the skier's hand and the pole. The support point also improves the grip and the contact between the hand and the handle. The support projects from a transverse surface of the handle. The support is made integral with the handle by molding it to a rounded tile-like shape. The upper surface of the support assumes the shape of the thumb, whereas the lower surface of the support enables a forefinger to be inserted easily.

During cross-country skiing, constant contraction of the hand muscles during the application of support forces can lead to aches or muscular pains. Thus, a number of users release the handle of the pole when they stop pushing, in order to relax the hand and forearm muscles. The wrist-strap is used to continue transmitting the support forces briefly after the release of the handle. The pole is then retained by the wrist-strap, which also enables the user to quickly grab the handle and to position the thumb on the appropriate support for the next thrust.

Due to various operational constraints, a handle that is completely suitable for a particular use and a given user can prove to be unsuited for another use or another user. Thus, the same user may have to use different poles for hiking or for a cross-country ski run. The same user may need to use different poles depending upon the condition of the snow or that of the cross-country ski trail. Various users can also adapt more or less well to the ergonomics of the handle and of the support. Thus, a child can discover that a handle designed for an adult causes pain in the area of the thumb support.

SUMMARY

The invention solves one or more of these disadvantages. To this end, the invention relates to a grip handle adapted to be fixed to the end of a pole intended for outdoor activity, including a body and a support member affixed to the body and projecting from a transverse wall of the body, the support member being arranged to support the thumb of a user holding the handle. The support member includes a structure to selectively modify and lock its position with respect to the body.

According to an alternative embodiment, the handle is structured and arranged to enable the support member to be displaced in a vertical direction, a transverse direction, and/or about a transverse axis with respect to the body, thereby making it possible to lock the position of the support member with respect the body after a displacement.

According to another alternative embodiment, the support member can selectively slide vertically in a groove provided in the body.

According to another alternative embodiment, the body includes a location adapted for the attachment of a wrist-strap, the support member being capable of selectively sliding up to a distance ranging between 15 and 25 millimeters (mm) from the aforementioned location.

According to another alternative embodiment, the support member is fixed to the body via an eccentric shaft, the rotation of the eccentric shaft causing a displacement of the support member with respect to the body.

According to another alternative embodiment, the handle includes a screw maintaining the support member affixed to the handle, the loosening or tightening of the screw making it possible to selectively modify or lock the position of the support member with respect to the body.

According to another alternative embodiment, the support member includes a surface for contact with the thumb of the user, such surface being made from a thermoformable material in the presence of the thumb of the user.

According to another alternative embodiment, the support member is removably fixed to the body.

According to another alternative embodiment, the handle is provided with at least one other support member separated from the handle and has a shape different from that of the support member already fixed removably to the handle, the other support member also being capable of being fixed removably to the body.

According to an alternative embodiment, the handle, in its lower portion, includes an opening for inserting and fixing a pole shaft.

The invention also relates to a support pole for outdoor activity, including a handle as described hereinabove, fixed in the area of its upper end.

BRIEF DESCRIPTION OF THE DRAWINGS

Other characteristics and advantages of the invention will become apparent from the description which follows, with reference to the annexed drawings which are provided only by way of nonlimiting examples, and in which:

FIG. 5 is a perspective view of the handle according to the first embodiment during use;

FIGS. 6 and 7 are side and transverse cross-sectional views, respectively, of a handle according to a second embodiment of the invention;

FIG. 12 is a perspective view of a handle provided with an alternative support member;

FIG. 13 is a front view of the handle of FIG. 12 during use;

FIG. 14 is a cross-sectional view of another alternative support member;

FIG. 15 is a cross-sectional view of a handle in the area of a mechanism for fixing the wrist-strap;

FIGS. 16 and 17 are perspective views of wrist-straps in the absence and presence, respectively, of the user's hand.

DETAILED DESCRIPTION

Figure 1:
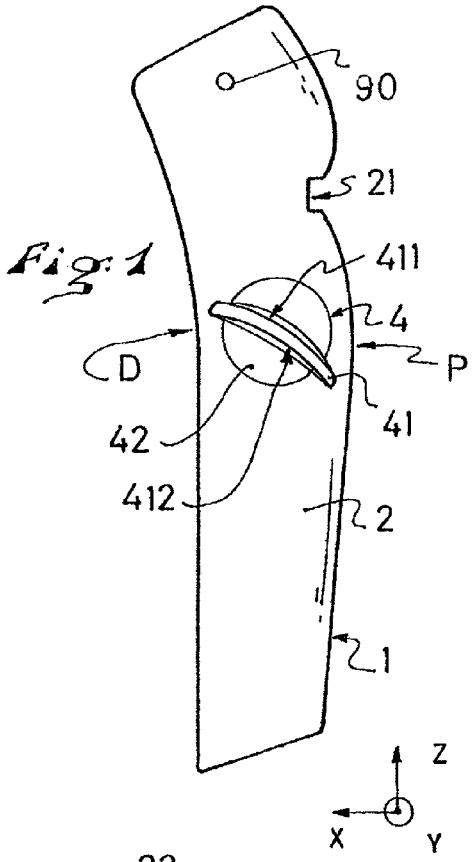
FIGS. 1 and 2 are side views of a handle according to a first embodiment of the invention.
Figure 2:
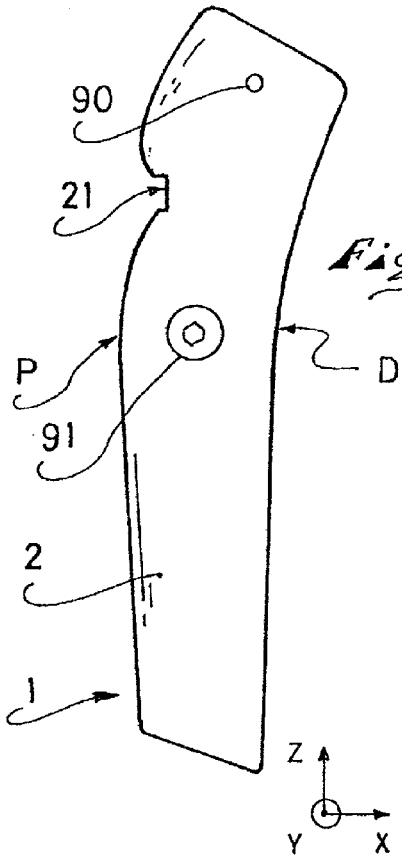
Figure 3:
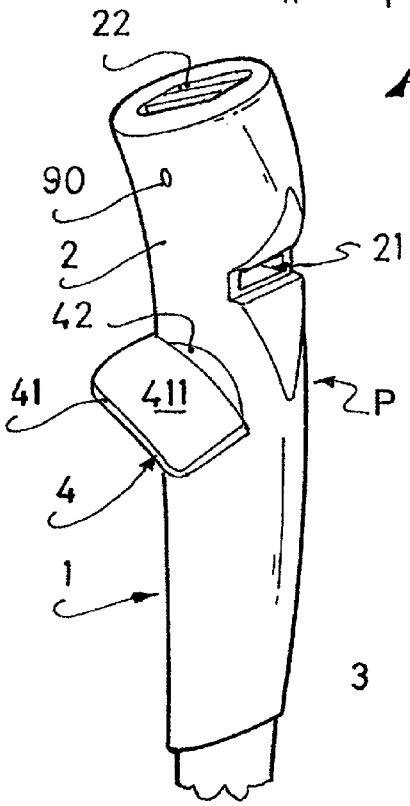
FIG. 3 is a perspective view of a handle according to the first embodiment.
Figure 4:
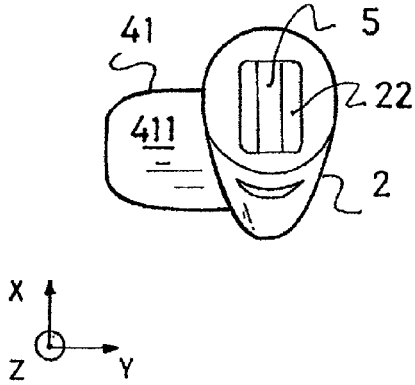
FIG. 4 is a top view of the handle according to the first embodiment.

The invention includes a grip handle capable of being fixed to a pole for an outdoor activity, such as a sports activity, including activities such as skiing and hiking. The handle has a body and a support member affixed to the body. The support member projects with respect to a transverse surface or wall of the body and is structured and arranged to support the thumb of a user holding the handle. The support member includes a structure to selectively modify and lock its position with respect to the body. That is, a position-modifying and position-locking structure provides for an adjustable movement of the support member and the locking of the support member in the adjusted position. This means that the support member can sequentially be positioned in an adjusting mode, or unlocked mode, in which its position is modifiable with respect to the body, and in a locking mode, or locked mode, in which its position is immobilized with respect to the body.

The invention makes it possible to easily modify the handle so that use of the pole is optimal for various uses or exercise conditions. The invention also makes it possible to easily modify the configuration of the handle to make it optimally usable for various users. The invention can be implemented at much reduced manufacturing costs, because the same body design can lead to very different ergonomics for use.

FIGS. 1 to 4 illustrate a handle 1 in the form of a substantially cylindrical body 2 having a peripheral wall, or surface. The handle 1 includes a support member 4 projecting laterally from one of its transverse surfaces, such as one of first and second transverse surfaces. The support member 4 includes a support portion 41, on the one hand, and an attachment portion 42, on the other hand. The attachment portion 42 is housed inside the body 2, whereas the support portion 41 projects with respect to a transverse surface of the body 2. When the body 2 is held in the user's hand, the user's thumb becomes positioned on the support portion 41. The support portion 41 forms an additional structure for axial transmission of forces on the pole 3 when the hand is closed on the body 2 along a natural position.

The portion 41 extends transversely along the axis Y, perpendicular to the transverse surface of the body 2. The support portion 41 has an upper surface 411 substantially having a curved, or rounded, tile-like shape. The contour of the surface 411 is directed upward so as to assume the shape of the user's thumb, or the engaging portion of the thumb, when the hand is closed on the body 2. The support portion 41 further has a lower surface 412 also having a rounded tile-like shape. When the user's hand is closed on the handle, the user's forefinger can thus slip under the support body 41 opposite the lower surface 412, which corresponds substantially to the natural position of a closed fist, as illustrated in FIG. 5.

The body 2 has a rear surface provided with a support zone P configured for the palm of the user's hand. The support zone P has a convex shape and dimensions adapted to fit ergonomically in the palm of the user's hand when the user's thumb is in contact with the support portion 41. The body 2 also has a front surface provided with a support zone D configured for engagement by the fingers of the user. As can be seen in FIG. 5, e.g., the upper end of the body 2 projects from the radial border of the user's hand, and the lower end of the body 2 projects from the ulnar border of the user's hand. The rear of the body 2 has an opening 21 positioned above the support zone P. The opening 21 is a location for fixing, or attaching, a wrist-strap, as will be described in detail hereinafter. The body 2 has an opening 22 in the area of its upper end. See FIG. 4, for example. The opening 22 extends substantially vertically inside the body 2, i.e., along a lengthwise direction of the body, until joining the opening 21. The opening 22 is adapted to house a member 5 for locking the wrist-strap, an example of which is described in detail hereinafter. In a known manner, the body 2 has an opening 24 in the area of its lower end. See FIG. 9, for example. The opening 24 extends substantially vertically inside the body 2, in order to receive and to be fixed to the shaft of a pole 3. More specifically, as schematically shown in FIGS. 8 and 9, the opening 24 is a blind hole or blind opening for receiving the upper end of the pole 3, the lower end being a snow-engaging or ground-engaging end 9.

In the exemplary embodiment of FIGS. 1 to 5, the attachment portion 42 of the support member 4 is rotationally mounted in a bore of the body 2 about the directional axis Y. By tightening or loosening a screw 91, the user can selectively immobilize or release a rotation of the attachment portion in the bore of the body 2. The screw 91 engages a threading arranged in the attachment portion 42 to provide suitable tightening. The user can thus selectively adjust and immobilize the rotational position of the support body 4 in order to adapt it to a desired ergonomics. This type of adjustability of the support body 4 can also be described as being in a direction not along or about the lengthwise direction of the body 2 of the grip handle. In the illustrated embodiment, surfaces of the body 2 of the grip handle 1, particularly those engageable by the four fingers of the hand, as shown in FIG. 5, e.g., are not provided for position-modification.

FIGS. 6 and 7 illustrate a second embodiment of a handle 1 according to the invention. This embodiment of the handle 1 makes it possible to adjust the position of the support member 4 along the vertical direction Z. In this example, the support member 4 is slidably mounted along the axis Z, in a groove 23 arranged in the body 2. The support member 4 is maintained in position with respect to the body 2 via an eccentric shaft 43. The eccentric shaft 43 is rotationally mounted about the axis Y with respect to the body 2. The rotational position of the eccentric shaft 43 can selectively be locked or released by action on an opposite screw, not shown. The eccentric shaft 43 has a circular head that is off-centered with respect to its rotational axis. The circular head is in abutment against the support portion 41, on the one hand, and against a lower abutment of the support member 4, on the other hand. Thus, during a rotation of the shaft 43, the position of the support member along the axis Z can be modified by making the support member 4 slide in the groove 23.

Figure 8:
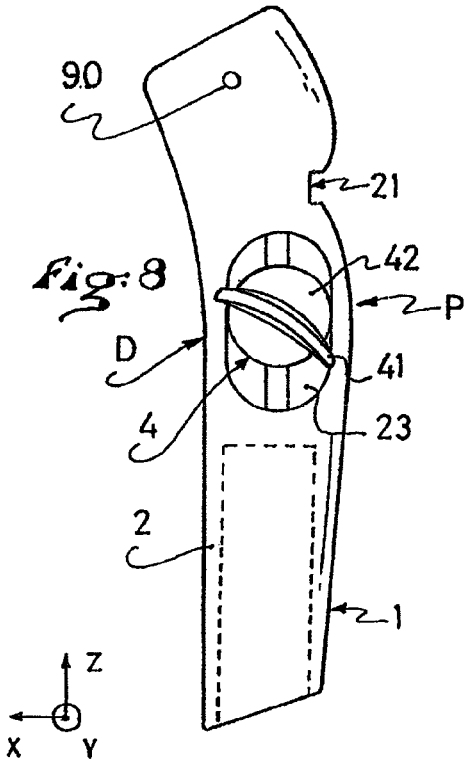
FIGS. 8 and 9 are side views of a handle according to a third embodiment of the invention.
Figure 9:
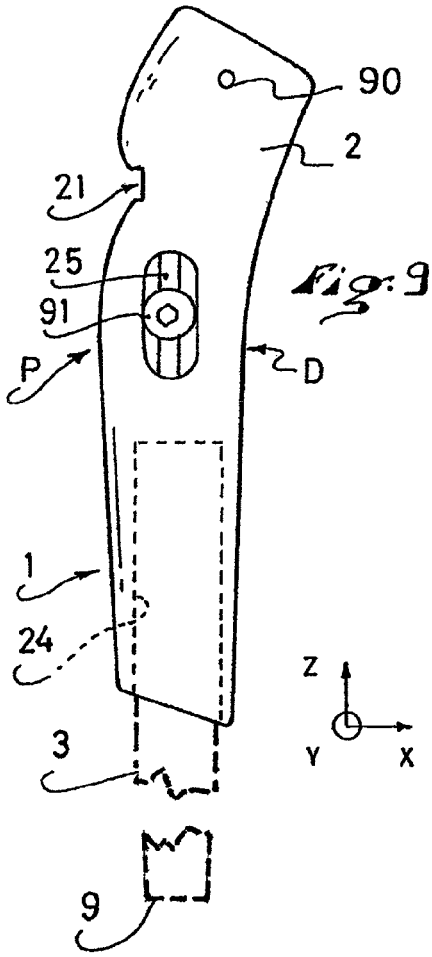

FIGS. 8 and 9 illustrate a third embodiment of a handle 1, which makes it possible to adjust the position of the support member 4, both rotationally about the axis Y and translationally along the axis Z. The attachment portion 42 is slidably mounted in a groove 23. A screw 91 flush on the transverse surface opposite the support member 4 makes it possible to selectively immobilize or release the position of the support member 4 depending upon the extent of its tightening. The screw 91 is slidably mounted along the axis Z with respect to body 2.

Figure 10:
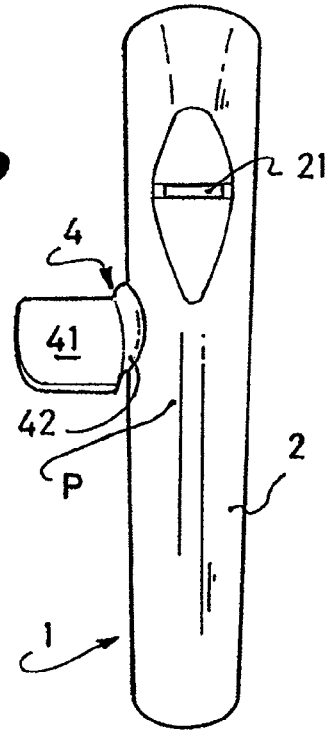
FIGS. 10 and 11 are rear and transverse cross-sectional views, respectively, of a handle according to a fourth embodiment of the invention.
Figure 11:
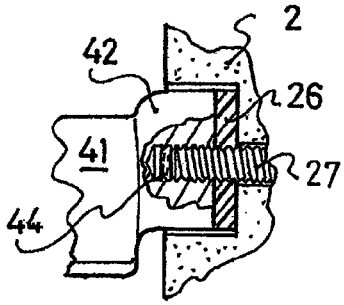

FIGS. 10 and 11 illustrate a fourth embodiment of a handle 1 according to the invention. In this embodiment, the support member 4 is removable to enable the insertion of a shim 26 of suitable size. The shim 26 makes it possible to offset the support member 4 along the direction Y. The shim 26 is inserted between the attachment portion 42 and a surface of a bore housing it. The attachment portion 42 can have a threaded bore 44, within which the threaded shaft 27 of a screw is screwed. Tightening via this threaded rod 27 makes it possible to immobilize the support member 4 in translation along the axis Y, on the one hand, and to immobilize the support member 4 in rotation about the axis Y after an adjustment, on the other hand.

A bushing with strong adherence ability can be inserted between the attachment portion 42 and its housing in the body 2, making it easier to preserve the positional adjustment of the support member 4. The invention also encompasses the junction between the support member 41 and the attachment portion 42 to have a certain flexibility, in order to provide a spring effect when the thumb of the user presses on the support member 4.

Advantageously, the support portion 41 is at a distance of approximately 20 mm from the opening 21 for fixing the wrist-strap 7. This distance advantageously ranges between 15 and 25 mm, and can be adjusted according to certain embodiments described in detail hereinafter. Such a distance is optimal for the transmission of thrust forces for most users.

Advantageously, the support member 4 is removably fixed on the body 2. Such removable attachment advantageously makes it possible to replace the support member 4 by a plug inserted into the opening into which the attachment portion is fitted, such as the aforementioned bore of the body 2, if it were desired by the user to remove and to use the pole without the support member. Alternatively, the removability of the support member also advantageously makes it possible to replace one support member with another having a different shape in order, for example, to adapt to other conditions of use.

In the exemplary embodiments illustrated and described heretofore, the support portion 41 has an upper surface with a convex curved tile-like shape. This shape is particularly suitable to adapt to supporting the thumb. This support portion 41 has a relatively reduced width and length. A reduced width enables the user's thumb to easily pass laterally upon releasing the handle when the user stops pushing, for example in cross-country skiing. A reduced length makes it possible to avoid pressing on the palm of the hand. Such a support member 4 can prove to be particularly suitable for leisure or recreational type of use (in which the user prefers comfort over performance) or for a relatively even or flat cross-country ski trail.

FIGS. 12 and 13 illustrate a handle 1 provided with a different type of support member. The support member 4 of this embodiment includes a support portion 41 that is broader and extends much lower and towards the palm with respect to the body 2. Such a shape for the support member 4 makes it possible to exert a thrust force with the palm of the hand 6, a zone of the hand having a very developed set of muscles. Such a shape can be promoted, for example, for a cross-country ski trail having a substantial uphill portion, requiring substantial thrust forces to be exerted on the pole.

FIG. 14 is a cross-sectional view of another alternative of a support member 4. The support portion 41 can have a width and a length with dimensions that are halfway between those of the alternatives of FIGS. 1 and 12. In addition, independent of its size, the support portion 41 has a contact surface 411 for the thumb of the user, made from a thermoformable material. The thermoformable material can be applied directly to the user's thumb, at temperatures that are not harmful to the user, so as to provide a custom shape specially adapted to the shape and contours of the thumb of the user. The thermoformable material advantageously has a melting point below 100° C., preferably below 80° C., and even below 65° C. The thermoformable material can be a polymer containing caprolactone or caprolactane. Such a material is distributed under the trade name "CAPA 6500". Such a thermoformable material can also be included as an additive in another thermoformable material having a higher softening temperature, in order to lower this softening temperature. The lower surface 412 can support the contact surface 411 and can be formed from a material having a higher softening temperature than that of the contact surface 411. Thus, a user can easily adapt the support member to his own morphology by pressing on the softened surface 411. A thermal protective film can be inserted between the surface 411 in the softened state and the thumb of the user during thermoforming. The surface 411 can be softened by any suitable heating means. Although FIG. 14 illustrates a support 4 in which only the support surface 411 is made of a material thermoformable, the scope of the invention also encompasses making the entire support portion 41 (or even the support portion 41 and the attachment portion 42) from thermoformable material.

Other types of support members 4 having other shapes or dimensions can also be used. Support members dedicated to children's hands can be made in smaller sizes. Support members 4 dedicated to female morphologies can be narrower. Various support members 4 can thus be selectively mounted on the same handle 1, thus avoiding the need to have various poles for various uses or users. The invention thus encompasses various levels of hardness for the surface 411 (to improve or not to improve the comfort), various surfaces of the surface 411, or various curvatures or morphologies for the surface 411.

The handle 1 can be distributed in the form of a kit provided with removable and interchangeable support members 4 in various shapes, for example by including a set of supports as illustrated in the preceding figures of drawings, as well as a filling stud adapted to be flush with the body 2.

FIG. 16 is a perspective view of an exemplary embodiment of a wrist-strap 7 that can be affixed to the body 2 of the handle 1. The wrist-strap 7 has a attachment tongue 71 adapted to be inserted within the opening 21 in order to be affixed to the handle 1. The attachment tongue 71 has an opening 72 in its median portion. The wrist-strap 7 includes a retaining element 73 that is fixed to the attachment tongue 71. The retaining element 73 forms a loop adapted to closely encircle the wrist of a user. The retaining element 73 also defines a plurality of openings adapted to allow the user's hand, thumb, and palm, respectively, to extend therethrough. FIG. 17 shows an alternative of the wrist-strap 7 worn by a user. The hand 6 of the user extends through the main opening of the wrist-strap 7. In this alternative, the wrist-strap 7 is provided with an adjusting strap 74 having the size of the main opening, in order to closely encircle the wrist of the user adequately.

FIG. 15 shows an example of how to fix such a wrist-strap 7 to the handle 1. A locking member 5 is inserted into the opening 22. The locking member 5 is movable with respect to the body 2, along the direction Z. The locking member 5 includes a locking stud 55.

In the position illustrated in FIG. 15, the attachment tongue 71 is inserted into the opening 21 and the locking stud 55 extends through the opening 72. In this position, the wrist-strap 7 is maintained affixed to the handle 1, and the locking member 5 is completely housed inside the body 2.

The locking member 5 includes an opening 52 for inserting a strip or band, such as the band 56 shown in FIG. 5. This opening 52 is overlaid by a bar 51 for retaining the band 56. The band 56 can encircle the bar 51 and secured by any suitable means, such as by means of stitching, for example. The band 56 enables the user to exert a force directed upward, in order to withdraw the bar 51 from the opening 22. With such a movement, the user raises the locking stud 55 up to a position where the attachment tongue 71 is no longer retained. The wrist-strap 7 is then detached from the handle 1.

The locking member 5 further includes a structure to retain it in either of the locked and unlocked positions. In the intermediate portion between the opening 52 and the locking stud 55, the locking member 5 has a groove 53 through which a pin 90 extends. This pin 90 can be made in the form of a metallic shaft fitted along the direction Y in the body 2. This intermediate portion of the locking member 5 has a thinned zone 54 that narrows down the groove 53. The thinning facilitates the elastic deformation of the zone 54. When the user moves the locking member 5 vertically with sufficient force to change the position thereof, the pin 90 elastically deforms the thinned zone to cross it. The thinned zone 54, once crossed, returns elastically in position to restore the narrowing of the groove 53. Because the pin 90 cannot move freely in the groove 53 without the user's intervention, the locking member 5 is prevented from rocking, or moving, accidentally between the locked and the unlocked positions.

Although the handles shown are designed to be coupled automatically to a wrist-strap due to a locking member comprising a stud that penetrates a tongue, the invention applies to any types of handles, such as, for example, a handle in which the straps of the wrist-strap are merely wedged by a shim, but also a handle having no wrist-strap.

The handle 1 can be mounted on a pole 3 adapted for a winter sport or on a pole adapted for summer activities, such as Nordic hiking or trail running.

The invention illustratively disclosed herein suitably may be practiced in the absence of any element which is not specifically disclosed herein.

The invention claimed is:

1. A grip handle adapted to be fixed to the end of a pole for use in an outdoor activity, said grip handle comprising:
- a body extending in a longitudinal direction;
- a support member affixed to the body and projecting from a transverse wall of the body;
- the support member having a support structure to support a thumb of a user when the user's hand is in engagement with the handle;
- the body having a finger-engaging structure to support the user's fingers when the user's hand is in engagement with the handle;
- a position-modifying and position-locking structure to enable the user to selectively modify and lock a position of the support member with respect to the body;
- the support structure of the support member comprising:
  - a support portion that comprises a thumb-supporting surface; and
  - an attachment portion that projects into the body of the grip handle.

2. A grip handle according to claim 1, wherein:
- the position-modifying and position-locking structure comprises a structure configured and arranged to provide adjustable movement of the support member according to the following: (1) along a length of the body and (2) transverse to the length of the body;
- the position-modifying and position-locking structure further comprises a structure locking the support member with respect to the body after said adjustable movement.

3. A grip handle according to claim 2, wherein:
- the position-modifying and position-locking structure further comprises a guide groove extending along a length of the body, the support member positioned to slide selectively in the groove.

4. A grip handle according to claim 1, wherein:
- the position-modifying and position-locking structure comprises a screw for maintaining the support member being affixed to the grip handle with respect to the body, so loosening or tightening of the screw selectively allows the position of the support member to be modified or locked with respect to the body.

5. A grip handle according to claim 1, wherein:
- said thumb-supporting surface is made of a thermoformable material and is adapted to have been molded into a shape in the presence of the user's thumb.

6. A grip handle according to claim 1, wherein:
- said support structure removably affixes the support member to the body.

7. A grip handle according to claim 6, further comprising:
- at least one additional support member, in addition to said support member, said additional support member being separated from and interchangeable with the grip handle and having a shape different from that of the support member affixed to the body;
- both said support member and said additional support member being removably affixable to the body.

8. A grip handle according to claim 1, further comprising:
- an opening in a lower portion of the body constructed and arranged to have a pole shaft inserted and fixed to the grip handle.

9. A grip handle according to claim 1, wherein:
- the body includes an upper end and a lower end, the upper end adapted to project from a radial border of the user's hand when engaged with the handle, the lower end adapted to project from the ulnar border of the user's hand when engaged with the handle;
- the grip handle further comprising:
  - a blind opening in the lower end of the body constructed and arranged to have a pole shaft inserted and fixed to the grip handle.

10. A grip handle according to claim 1, further comprising:
- a flexible junction between the support portion and the attachment portion, the flexible junction providing a spring effect in response to pressure applied on the support member by the user's thumb.

11. A grip handle according to claim 1, wherein:
- the attachment portion is mounted for rotation within an opening of the body of the grip handle.

12. A grip handle according to claim 11, wherein:
- the position-modifying and position-locking structure comprises a screw extending into the body of the grip handle and into engagement with the attachment portion within the body.

13. A grip handle adapted to be fixed to the end of a pole for use in an outdoor activity, said grip handle comprising:
- a body;
- a support member affixed to the body and projecting from a transverse wall of the body;
- the support member having a support structure to support a thumb of a user when the user's hand is in engagement with the handle;
- a position-modifying and position-locking structure to enable the user to selectively modify and lock a position of the support member with respect to the body;

the position-modifying and position-locking structure comprising a structure configured and arranged to provide adjustable movement of the support member in at least one of the following: along a length of the body, transverse to the length of the body, and about an axis extending transverse to the body;

the position-modifying and position-locking structure further comprising a structure configured and arranged to lock the support member in place after said adjustable movement;

the position-modifying and position-locking structure comprising a guide groove extending along the length of the body, the support member positioned to slide selectively in the groove;

a location structured and arranged to attach a wrist-strap to the body of the grip handle;

the position-modifying and position-locking structure further being configured to provide the support member slidable adjustment within a distance ranging between 15 and 25 mm from said location.

14. A grip handle adapted to be fixed to the end of a pole for use in an outdoor activity, said grip handle comprising:

a body extending in a longitudinal direction;

a support member affixed to the body and projecting from a transverse wall of the body;

the support member having a support structure to support a thumb of a user when the user's hand is in engagement with the handle;

the body having a finger-engaging structure to support the user's fingers when the user's hand is in engagement with the handle;

a position-modifying and position-locking structure to enable the user to selectively modify and lock a position of the support member with respect to the body;

the position-modifying and position-locking structure comprising:

a structure configured and arranged to provide adjustable movement of the support member according to at least one of the following: (1) along a length of the body and (2) transverse to the length of the body;

a structure locking the support member with respect to the body after said adjustable movement; and an eccentric shaft fixing having one end operatively receiving the locking structure for the support member to the body, and the shaft having a head off-centered with respect to a rotational axis of the shaft so that rotation of the eccentric shaft causes a displacement of the support member with respect to the body.

* * * * *